US010741129B2

(12) United States Patent
Wacyk et al.

(10) Patent No.: US 10,741,129 B2
(45) Date of Patent: Aug. 11, 2020

(54) RECONFIGURABLE DISPLAY AND METHOD THEREFOR

(71) Applicants: eMagin Corporation, Hopewell Junction, NY (US); UNITED STATES OF AMERICA, AS REPRESENTED BY THE SECRETARY OF THE ARMY

(72) Inventors: Ihor Wacyk, Hopewell Junction, NY (US); Hyuk Sang Kwon, Sunnyvale, CA (US); Russell Draper, Hopewell Junction, NY (US); David Fellowes, Hopewell Junction, NY (US)

(73) Assignees: eMagin Corporation, Hopewell Junction, NY (US); UNITED STATES OF AMERICA, AS REPRESENTED BY THE SECRETARY OF THE ARMY, Washington, DC (US)

( * ) Notice: Subject to any disclaimer, the term of this patent is extended or adjusted under 35 U.S.C. 154(b) by 66 days.

(21) Appl. No.: 15/666,041

(22) Filed: Aug. 1, 2017

(65) Prior Publication Data

US 2018/0075811 A1 Mar. 15, 2018

Related U.S. Application Data

(60) Provisional application No. 62/369,501, filed on Aug. 1, 2016.

(51) Int. Cl.

| | |
|---|---|
| ***G09G 5/02*** | (2006.01) |
| ***G09G 5/10*** | (2006.01) |
| ***G09G 3/36*** | (2006.01) |
| ***G09G 3/3266*** | (2016.01) |

(Continued)

(52) U.S. Cl.

CPC ..... *G09G 3/3266* (2013.01); *G09G 3/3233* (2013.01); *G09G 3/3291* (2013.01); *G09G 2300/0842* (2013.01); *G09G 2310/0213* (2013.01); *G09G 2310/0251* (2013.01);

(Continued)

(58) Field of Classification Search

CPC . G06F 3/013; G06F 3/017; G02B 2027/0178; G02B 27/017

See application file for complete search history.

(56) References Cited

U.S. PATENT DOCUMENTS 4,633,242 A 12/1986 Sekiya
7,046,222 B2 5/2006 Kim et al.

(Continued)

*Primary Examiner* — Nan-Ying Yang

(74) *Attorney, Agent, or Firm* — Kaplan Breyer Schwarz, LLP

(57) ABSTRACT

An image rendering system comprising a pixel array and variable-density column and row scanner circuits is disclosed. The variable-density column and row scanner circuits enable software-based reconfiguration of the active display area within the available screen area of the display. In addition, a hardware restore-to-black function is provided that enables pixels outside of the desired image region to be driven to black without their requiring image data or excitation. As a result, the functionality of the functionality of the display can be reconfigured to match the desired image region on a frame-by-frame basis. Therefore, displays in accordance with the present invention can operate at higher frame rates and with less power consumption that prior-art displays.

14 Claims, 11 Drawing Sheets

(51) Int. Cl.
*G09G 3/3291* (2016.01)
*G09G 3/3233* (2016.01)

(52) U.S. Cl.
CPC ..... *G09G 2310/0259* (2013.01); *G09G 2310/0262* (2013.01); *G09G 2310/04* (2013.01)

(56) References Cited

U.S. PATENT DOCUMENTS

| | | | | |
|---|---|---|---|---|
| 2007/0075938 | A1* | 4/2007 | Sung | G09G 3/3233 345/76 |
| 2008/0225033 | A1 | 9/2008 | Hector | |
| 2009/0146915 | A1 | 6/2009 | Marathe | |
| 2011/0157489 | A1 | 6/2011 | Ichioka et al. | |
| 2011/0285764 | A1* | 11/2011 | Kimura | G09G 3/3426 345/697 |
| 2013/0208019 | A1 | 8/2013 | Lee et al. | |
| 2015/0248210 | A1* | 9/2015 | Lee | H04N 21/44218 345/593 |
| 2016/0019842 | A1 | 1/2016 | Kim | |
| 2016/0203768 | A1 | 7/2016 | Yoon et al. | |

* cited by examiner

300

302

RECONFIGURABLE DISPLAY AND METHOD THEREFOR

STATEMENT REGARDING FEDERALLY SPONSORED RESEARCH

This invention was made with Government support under Grant Award No. W909MY-12-D-0005 awarded by the U.S. Army Contracting CMD-APG; Night Vision and Electronic Sensors Directorate (NVESD) Imaging Technology Branch. The United States Government has certain rights in the invention.

FIELD OF THE INVENTION

The present invention relates to image-rendering devices, such as displays, in general, and, more particularly, to backplane electronics for driving image-rendering devices.

BACKGROUND OF THE INVENTION

Image-rendering devices, such as, televisions, displays, microdisplays, etc., typically include a two-dimensional array of pixel elements and a backplane drive circuit that controls the emission of each pixel in the array to render an image.

Prior-art displays are typically designed for a particular functionality and display format, which is hardwired into its backplane drive circuit. There are a number of applications, however, that would benefit from a flexible display architecture that can be operated efficiently when used to display images in non-native formats. For example, energy efficiency is paramount in many portable applications wherein different kinds of sensor inputs or video stream formats must be viewed while in the field. Unfortunately, while many displays are characterized by a slight decrease in total power consumption when displaying an image that is smaller than its native format, the energy savings are small since the display efficiency typically drops significantly in such circumstances.

In addition, every pixel of a prior-art display must be written to and energized during each frame period. This is true even for unused pixels that lie outside of an image formed in a smaller sub-region of a display because these pixels must still be written as black during each frame period. As a result, a prior-art display has a pre-determined fixed frame period that determines its maximum achievable frame rate.

Some applications, such as immersive virtual-reality headsets, for example, require high pixel count and fast motion response, which give rise to unrealizable data processing and communication bandwidth demands using conventional display technology.

High pixel count is necessary to achieve a wide field-of-view with eye-limited angular resolution for a realistic VR experience. On the other hand, high frame rates are needed to avoid motion artifacts, such as image blur and judder, which are particularly visible in a near-eye system and have led to headaches and motion sickness for many users. Together, these requirements lead to raw video data rates of many tens of gigabits per second, which are beyond the limits of today's fastest graphics processor and video interface driver chips.

The need for a display technology that enables fast, flexible image rendering remains, as yet, unmet in the prior art.

SUMMARY OF THE INVENTION

The present invention enables a display with a display format that is software reconfigurable. It enables the format of a display to be changed on the fly, as well as positioning of the displayed image anywhere within the full display area on a frame-by-frame basis. Furthermore, the present invention enables a display whose format is smaller than the full display area to operate at significantly higher frame refresh rates and/or with better energy efficiency—approaching or attaining the energy efficiency of a dedicated display that is optimized for the smaller display format being displayed.

Embodiments of the present invention comprise row and column scanning circuitry whose beginning and end points can be controlled, in which the density of columns and rows activated can controlled, and that can set pixels outside a desired display region to black without requiring that those pixels be written to and energized during each frame period. Embodiments of the present invention are particularly well suited for Active-Matrix Organic Light Emitting Diode (AMOLED) displays, virtual reality (VR) and augmented reality (AR) headsets, and the like.

In the prior art, a display is typically designed for a functionality (i.e., display format) that is hardwired into its backplane drive circuit. An image is formed on the display by scanning data and energizing each pixel of the display in a left-to-right and top-to-bottom raster-scan pattern. The display is typically optimized to operate most efficiently at the display's native format (i.e., when all the pixels are driven). When an image is displayed in a sub-portion of the display, data must still written to each and every pixel of the entire display, all of which are still energized during each frame period—even those pixels that are outside of the sub-portion being used to form the image. As a result, both the frame period and the energy required to display an image on a prior-art display are fixed, regardless of how much of the display is used.

In sharp contrast to the prior art, displays in accordance with the present disclosure employ a backplane architecture whose functionality is reconfigurable through software control. As a result, embodiments of the present invention can operate with increased efficiency and performance for a wider set of display formats—ranging from very small up to the full native format. Embodiments of the present invention, therefore, enable longer battery life for portable headsets (e.g., VR and AR headsets, etc.), faster motion response in gaming and defense applications, better connectivity and pixel-rendering solutions for high-resolution microdisplays. The present invention also makes possible the replacement of multiple products with a single device.

An illustrative embodiment of the present invention is an AMOLED display comprising a backplane architecture that includes variable-density row and column scanner logic. In addition, each pixel in the display includes a circuit element that enables restore-to-black (RST) functionality in the pixel, by which the pixel is made black without requiring it to be addressed by the row and column scanners.

Each of the variable-density row and column scanners includes start/stop pointer logic that defines the start and stop positions used by the row and column scanners. As a result, the pointer logic in the column scanner controls which memory cells in the data memory block are updated when video data is written to each row of the display and the pointer logic of the row scanner controls which rows of the display are active. The rows and columns outside the bounds of the start and stop positions are not updated with video data and are, instead, driven into their RST state via separate signal lines dedicated for this purpose.

In some embodiments, the RST function is provided in only one of the row and column scanners.

An embodiment in accordance with the present disclosure is a display for displaying an image, the display comprising: a pixel array having a plurality of pixels that is arranged into a first plurality of rows and a first plurality of columns, wherein the first plurality of rows includes N rows and the first plurality of columns includes M columns; and a driver architecture operative for providing first and second pointers that define the lateral extent of the image, the drive architecture comprising a column scanner circuit that is dimensioned and arranged to provide a first drive signal to each column of a second plurality of columns, the columns of the second plurality thereof being based on the first and second pointers, wherein the number of columns in the second plurality thereof is controllable within the range of 1 through M; wherein the first plurality of columns includes the second plurality of columns.

Another embodiment in accordance with the present disclosure is a display for displaying an image, the display comprising: a plurality of pixels that is arranged into a first plurality of rows and a first plurality of columns, each pixel of the plurality thereof including an organic light-emitting diode (OLED), wherein the first plurality of rows includes N rows and the first plurality of columns includes M columns; and a driver architecture for driving each pixel of the plurality thereof, wherein the driver architecture is reconfigurable such that it can selectively drive a second plurality of columns having a number of columns that is controllable within the range of 1 through M; wherein the first plurality of columns includes the second plurality of columns.

Yet another embodiment in accordance with the present disclosure is a method for displaying an image on a display, the method comprising: (1) providing the display such that it includes: (i) a first plurality of pixels arranged into a first plurality of rows and a first plurality of columns, each pixel of the first plurality thereof including an organic light-emitting diode (OLED), wherein the first plurality of rows includes N rows and the first plurality of columns includes M columns; and (ii) a display architecture that is operative for driving each pixel of the first plurality thereof; (2) providing first and second pointers that define the lateral extents of the image; (3) defining a second plurality of columns based on the first and second pointers, the second plurality of columns having a number of columns that is controllable within the range of 1 through M, wherein the first plurality of columns includes the second plurality of columns; (4) selectively writing data to the pixels of the second plurality of columns; (5) selectively energizing the pixels of the second plurality of columns; and (6) disabling the OLED of each pixel not included in the second plurality of columns.

DETAILED DESCRIPTION

Figure 1:
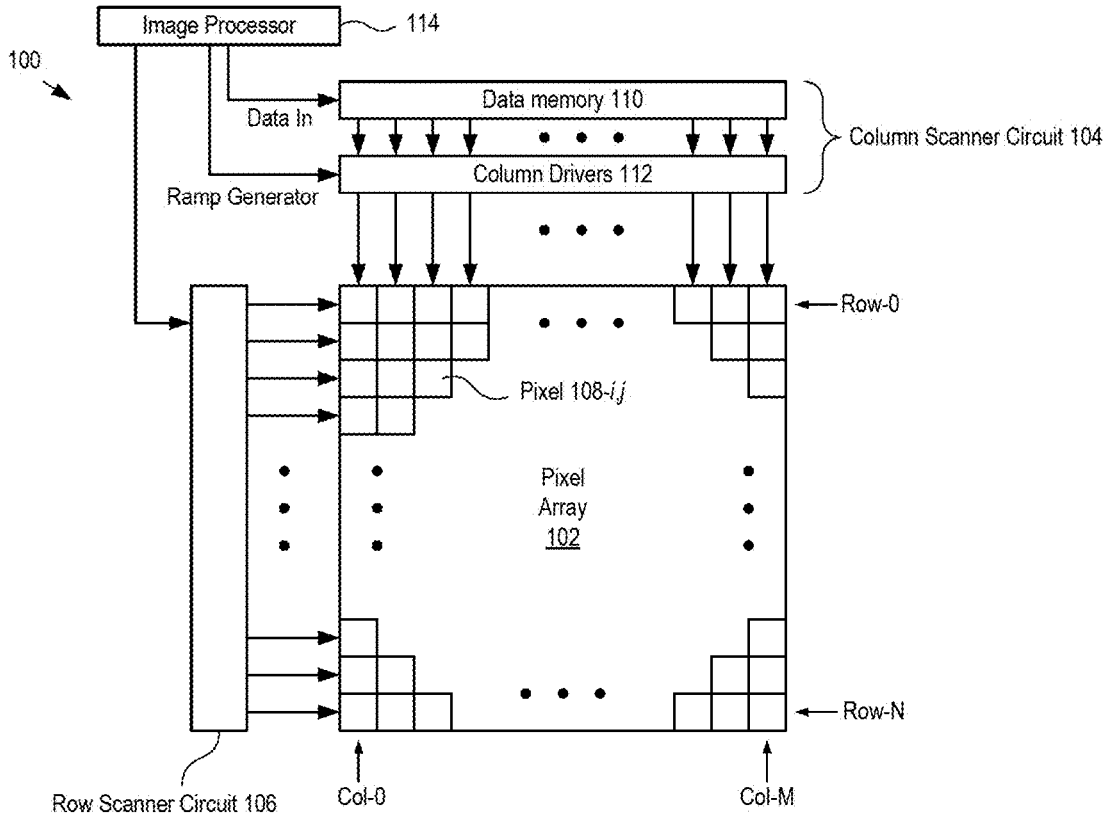
FIG. 1 (Prior Art)
FIG. 1 depicts a schematic drawing of an image-rendering system in accordance with the prior art.

FIG. 1 depicts a schematic drawing of an image-rendering system in accordance with the prior art. Display 100 comprises pixel array 102, column scanner circuit 104, and row scanner circuit 106. In the depicted example, display 100 is an organic light-emitting diode (OLED) microdisplay; however, it will be clear to one skilled in the art, after reading this Specification, that the teachings of the present disclosure are applicable to myriad image-rendering systems.

Pixel array 102 includes a two-dimensional array of pixels 108 having N rows and M columns, where each of N and M is any practical number. Each of pixels 108 includes an OLED whose light output is based on a data signal provided to it (not shown in FIG. 1) when the pixel is activated, as described below.

Column scanner 104 is conventional column-scanning logic circuit that provides a different drive signal, one at a time, to each column j, where j=1 through M, of pixel array 102. Column scanner 104 includes data memory 110 and column drivers 112, where the data memory includes a plurality of shift registers for storing serial-video data provided by conventional image processor 114. The video data is then converted to voltages and provided to columns Col-1 through Col-M by the column drivers.

In similar fashion, row scanner 106 provides a different drive signal, one at a time, to each row i, where i=1 through N, of pixel array 102.

When column scanner circuit 104 drives column j and row scanner circuit 106 drives row i, the OLED of pixel 108-*i*-*j* is enabled and can emit light in response to an applied data signal (i.e., the pixel is activated).

Figure 2:
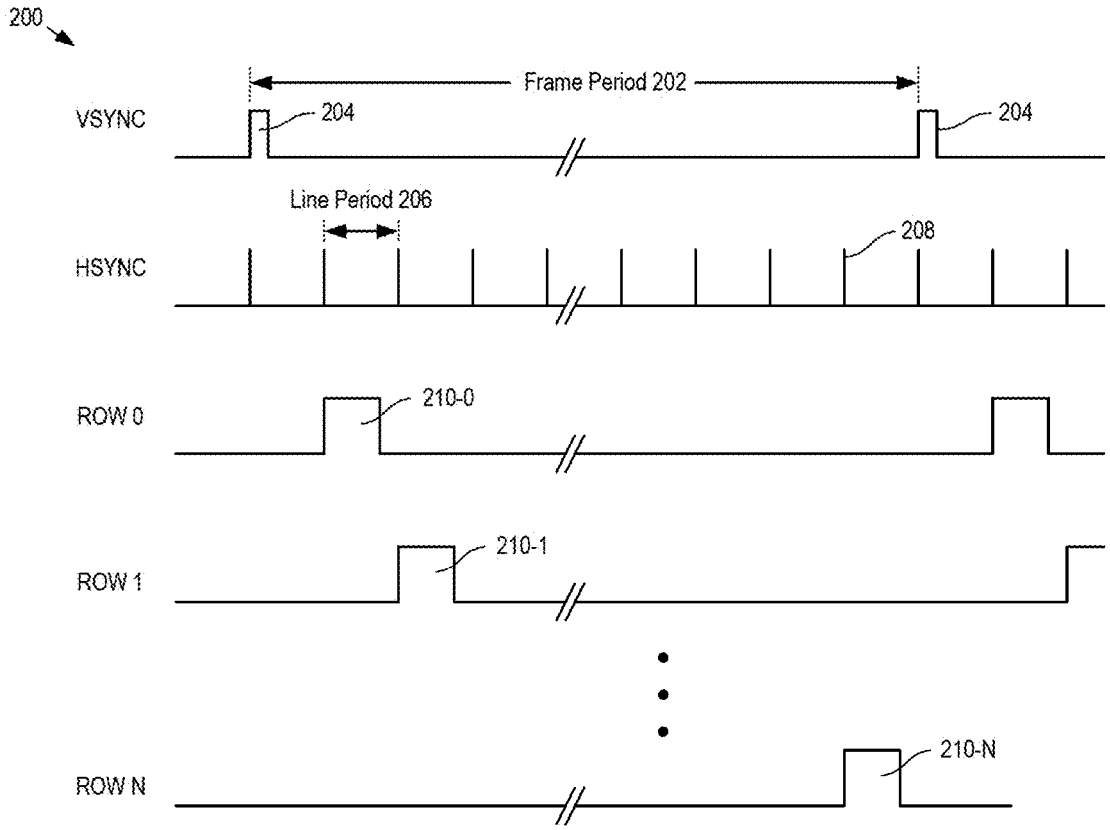
FIG. 2 (Prior Art)
FIG. 2 depicts a timing diagram for a display frame in accordance with the prior art.

FIG. 2 depicts a timing diagram for a display frame in accordance with the prior art. In a conventional display, pixels 108-1,1 through 108-N,M are updated one-at-a-time, typically in a left-to-right and top-to-bottom raster pattern.

Diagram 200 shows the timing relationship between the main clock and the row drive signals. Frame period 202 is defined by time between successive VSYNC pulses 204 of vertical synchronization clock VSYNC. Each VSYNC pulse 204 starts a frame period 202 which terminates at the beginning of the next VSYNC pulse. During each frame period 202, all N rows of display 100 are updated, one at a time, in a sequential fashion.

The duration of each line period 206 is defined by the time between successive HSYNC pulses 208 of horizontal synchronization clock HSYNC. During each line period, one row is selected and the pixels along that row are updated one at a time by the column scanner function.

The refresh time required to update the entire array of pixels in display 100 determines the maximum frame rate at which it can be operated. In addition, since a set amount of energy must be expended to address each pixel, whether or not the information to that pixel is changed or relevant, display 100 will always dissipate at least a minimum level of power consumption. Typically, display 100 and its pixel driving circuitry are optimized for substantially maximum efficiency when the display is presenting a full-screen image (i.e., when all the pixels in the array are actively driven).

Figure 3A:
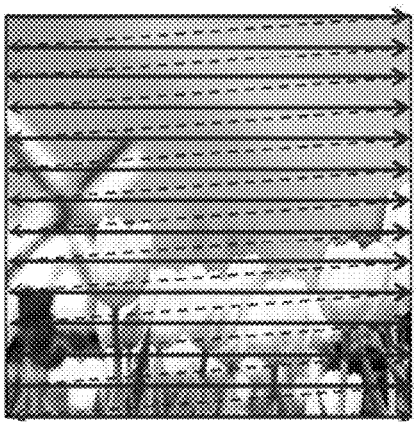
FIG. 3A (Prior Art)
FIG. 3A depicts the raster scan pattern for a full-screen image displayed on a prior-art display.

FIG. 3A depicts the raster scan pattern for a full-screen image displayed on a prior-art display. Image 300 is a full-screen image displayed such that it extends over the entirety of display 100.

Unfortunately, when displaying an image on a sub-portion of a conventional image-rendering system, the amount of time and energy required remains the same as that for a full-screen image because even unused pixels must be set to black during every frame period.

Figure 3B:
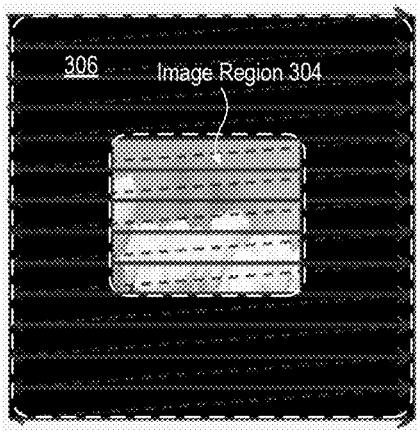
FIG. 3B (Prior Art)
FIG. 3B depicts the raster scan pattern for a partial-screen image displayed on a prior-art display.

FIG. 3B depicts the raster scan pattern for a partial-screen image displayed on a prior-art display. Image 302 is an image displayed on only a sub-portion of display 100. Image 302 includes image region 304 and dormant region 306.

Despite the fact that no information is displayed within dormant region 306, data must still be written into all the pixels that lie within this unused region to set them to black during each and every frame period. As a result, power consumption is unnecessarily high and the achievable frame rate remains limited by the overall display pixel count.

Figure 4:
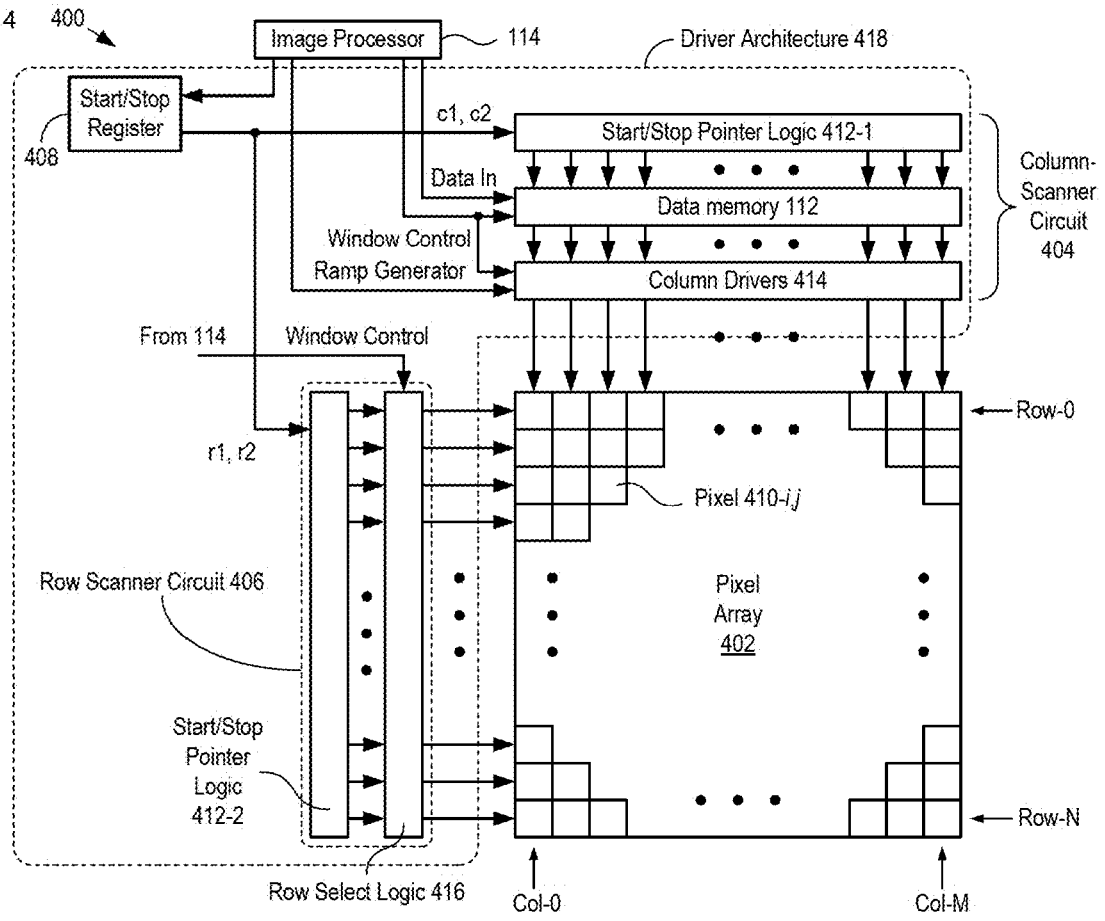
FIG. 4 depicts a schematic drawing of an image-rendering system in accordance with an illustrative embodiment of the present invention.

FIG. 4 depicts a schematic drawing of an image-rendering system in accordance with an illustrative embodiment of the present invention. Display 400 comprises pixel array 402, column scanner circuit 404, row scanner circuit 406, and start/stop register 408. Column scanner circuit 404, row scanner circuit 406, and start/stop register 408 collectively define driver architecture 418. Display 400 is characterized by a display functionality that is software controllable.

Pixel array 402 is analogous to pixel array 102; however, each of pixels 410-1,1 through 410-M,N includes a restore function that enables it to be set to black without requiring any data input. A representative pixel 410 is described below and with respect to FIG. 6.

Column scanner circuit 404 is a variable-density column scanner that includes start/stop pointer logic 412-1, data memory 112, and column drivers 414.

Figure 5:
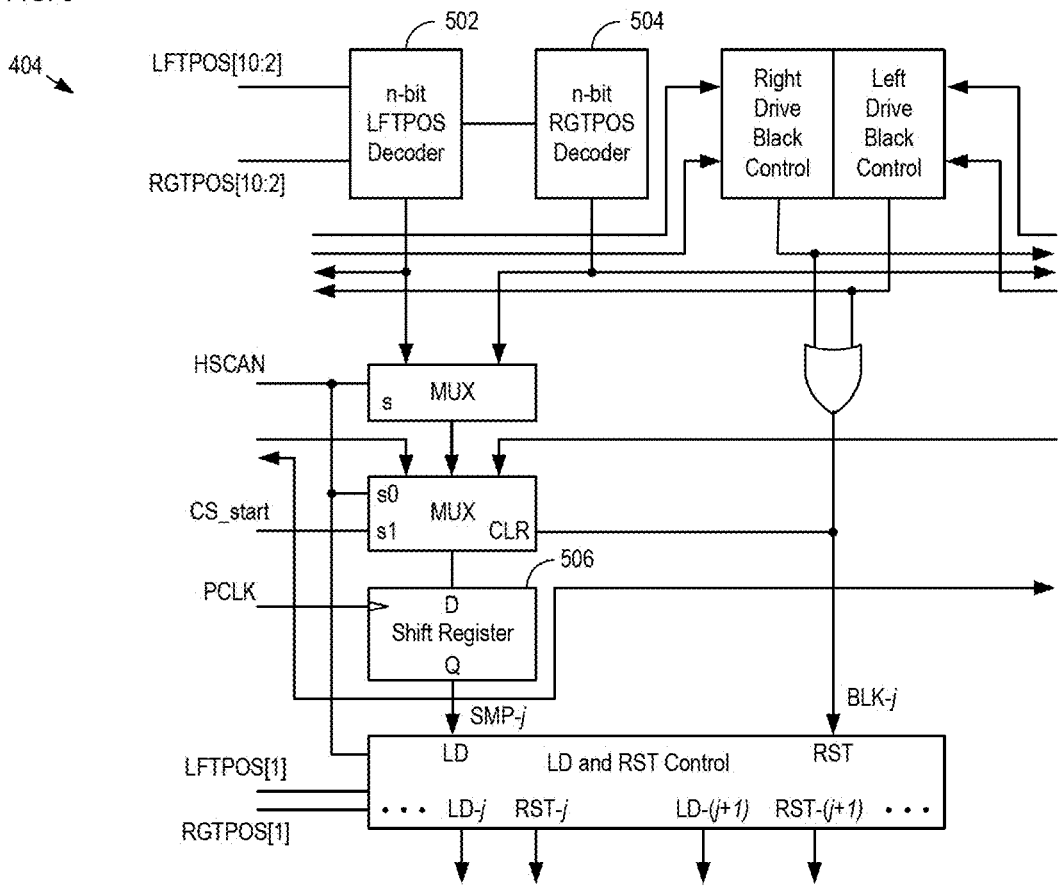
FIG. 5 depicts a portion of the logic of a variable-density column scanner circuit in accordance with the illustrative embodiment.

FIG. 5 depicts a portion of the logic of a variable-density column scanner circuit in accordance with the illustrative embodiment. Column scanner circuit 404 is analogous to column scanner circuit 104; however, column scanner circuit 404 includes start/stop pointer logic 412-1, which enables the density of the column scanner circuit to be varied.

Start/stop pointer logic 412-1 includes logic circuitry that can be reconfigured via software commands (e.g., provided to start/stop register 408) to control which memory cells in data memory 112 are updated when serial video data is written to display 400. In the depicted example, start/stop pointer logic 412-1 includes a pair of n-bit decoders (i.e., decoders 502 and 504), where n is equal to the number of column drivers included in column drivers 414. Decoders 502 and 504 establish the start and stop bits in data memory shift register 506 within circuit 404.

In addition, in some embodiments, at least one of start/stop pointer logic 412-1 and column drivers 414 is modified to enable columns outside the range defined by start/stop register 408 to be driven to a fixed black level without writing data to them. In the depicted example, all column lines outside the active window region of display 400 are driven to black substantially simultaneously such that little or no timing overhead is required.

Row scanner circuit 406 includes start/stop pointer logic 412-2 and row select logic 416. Start/stop pointer logic 412-2 operates as described above, vis-à-vis start/stop pointer logic 412-1. In some embodiments, at least one of start/stop pointer logic 412-2 and row select logic 416 is modified to enable rows outside the range defined by start/stop register 408 to be driven to a fixed black level without writing data to them.

Start/stop register 408 is a logic circuit that provides pointers c1 and c2 to start/stop pointer logic 412-1 and pointers r1 and r2 to 412-2, where pointers c1 and c2 define the start and stop positions of the columns and pointers r1 and r2 define the start and stop positions of the rows of the display region to be written during a frame period. In some embodiments, the functionality of start/stop register 408 is incorporated into one or both of column scanner circuit 404 and row scanner circuit 406.

Column drivers 414 are analogous to conventional column drivers 110; however, column drivers 414 include signal lines for providing a restore-to-black (RST) signal to each pixel outside of the image region displayed by display 400.

Row select logic 416 is analogous to conventional row scanner circuit 106; however, row select logic 416 also includes signal lines for providing an RST signal to the pixels in each row outside of the image region displayed by display 400. Rows outside the active window region of display 400 are driven to black in substantially simultaneous fashion within one HSYNC cycle at the beginning of a frame period. As a result, little or no timing overhead is required.

Figure 6:
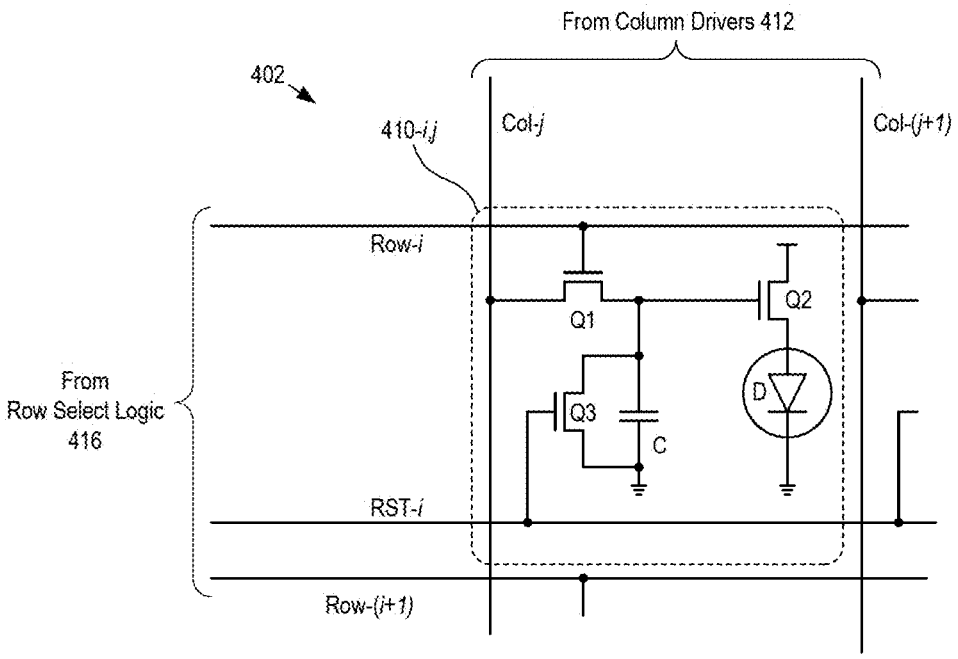
FIG. 6 depicts a region of a pixel array comprising a pixel with row-RST functionality in accordance with the illustrative embodiment.

FIG. 6 depicts a region of a pixel array comprising a pixel with row-RST functionality in accordance with the illustrative embodiment. Pixel 410-*i*-*j* is representative of each of pixels 108-1,1 through 108-N,M. Pixel 410-*i*-*j* includes transistors Q1, Q2, and Q3, OLED D, and capacitor C.

Pixel 410-*i*-*j* is analogous to a conventional OLED driver; however it includes additional switch for providing row RST functionality—namely, transistor Q3. In the depicted example, the gate of Q3 is electrically connected with RST line RST-i, which is electrically coupled with row select logic 418. When the switch is activated by applying signal RST-i to the gate of Q3, the gate of transistor Q2 is driven low, thereby disabling current flow through OLED D.

The addition of transistor Q3 enables capacitor C to be discharged quickly, thereby putting OLED D in a non-emissive (i.e., black) state without any impact on the refresh rate and with very little power consumption. As a result, a virtual window formed within display 400 can be updated and relocated within the display area without having to refresh the data for each unused pixel during each frame period. As a result, the number of pixels that must be addressed during each frame period is less, which enables display 400 to operate at significantly higher frame refresh rates when operating at smaller format sizes, thereby mitigating issues such as motion artifacts (e.g., blur, judder, etc.) that plague prior-art displays. The addition of transistor Q3 also enables display 400 to switch between a high-resolution, reduced format and a lower-resolution, full-screen format on a frame-by-frame basis. This enables, for example, a high-resolution virtual window to be displayed within a lower-resolution background image at high refresh frequencies and low input video bandwidth.

It is an aspect of the present invention that a reconfigurable display in which only the regions in which information is displayed are written to and activated during each frame period enables lower power consumption and/or higher frame rates than can be achieved in the prior art. Displays in accordance with the present invention enable a "virtual-window mode" in which an image is displayed in a sub-region of the display that matches the size of the image at its desired resolution. A virtual-window mode is effected by reconfiguring the row and column scanner logic so that only a subset of the available scanners are made operational. The regions outside the displayed image are all driven to black. A vector that extends from the upper-left corner of the full array to the upper-left corner of the virtual window is defined by a group of register settings and is used to set the position of the virtual window. In accordance with the present invention, the vector coordinates can be updated at every frame period such that the virtual window can be moved within the available screen area of the display at a very fast rate.

Figure 7:
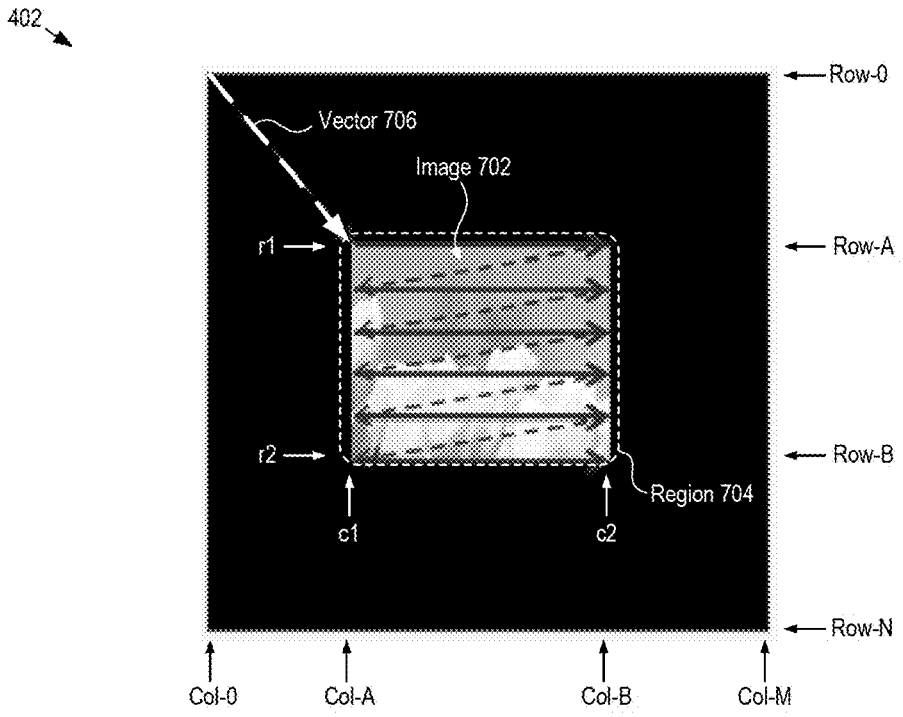
FIG. 7 depicts an image displayed in a sub-portion of a display in accordance with the illustrative embodiment.

FIG. 7 depicts an image displayed in a sub-portion of a display in accordance with the illustrative embodiment. Image 702 is a high-resolution image displayed within region 704, which is a sub-region of display 400. Image 702 is displayed with an offset from the upper left corner of the display by vector 706. As shown in FIG. 7, raster scanning only occurs within region 704.

Figure 8:
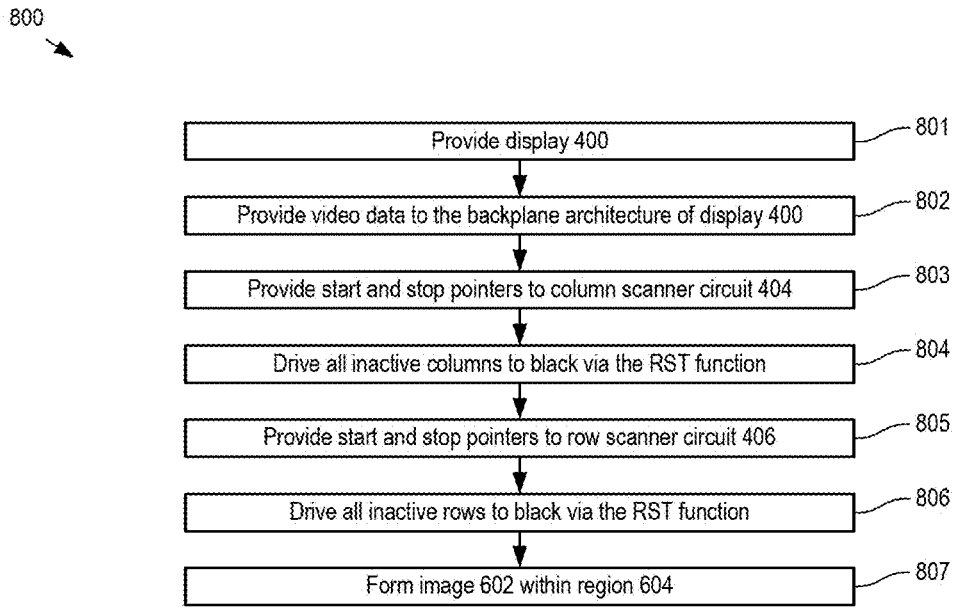
FIG. 8 depicts operations of a method for displaying an image in a sub-portion of a display in accordance with the illustrative embodiment.

FIG. 8 depicts operations of a method for displaying an image in a sub-portion of a display in accordance with the illustrative embodiment. Method 800 begins with operation 801, wherein display 400 is provided. Method 800 is described herein with continuing reference to FIG. 4-7, as well as reference to FIGS. 9-11.

At operation 802, image processor 114 provides a video-data stream for a frame of image 702 to the backplane architecture of display 400.

At operation 803, start/stop register 408 provides start and stop pointers, c1 and c2, to column scanner circuit 404. Pointer c1 denotes the position within the display of the first column to be energized (i.e., Col-A) during the frame period of the image frame, while pointer c2 denotes the position within the display of the last column to be energized (i.e., Col-B) during the frame period. In the depicted example, the pointers c1 and c2 are greater than 0 and less then M, respectively.

At operation 804, all columns outside the range of Col-A through Col-B (i.e., all inactive columns) are driven to black via the RST function by driving RST high, as described above and with respect to FIG. 6.

At operation 805, start/stop register 408 provides start and stop pointers, r1 and r2, to row scanner circuit 406. Pointer r1 denotes the position within the display of the first row to be energized (i.e., Row-A) during the frame period of the image frame, while pointer r2 denotes the position within the display of the last row to be energized (i.e., Row-B) during the frame period. In the depicted example, the pointers r1 and r2 are greater than 0 and less then N, respectively.

At operation 806, all rows outside the range of Row-A through Row-B (i.e., all inactive rows) are driven to black via the RST function by driving RST high.

It should be noted that the values of r1 and c1 define vector 706, as shown in FIG. 7. In the depicted example, vector 706 is the offset between the top left corners of region 704 and display 400. As a result, image 702 can be quickly moved within the full area of display 400, from frame to frame, simply by updating the value of one or both of r1 and c1.

At operation 807, image 702 is formed within region 704. Image 702 is typically formed via raster scanning, wherein the active pixels are written to and energized sequentially across each row, one at a time from top to bottom, in region 704.

Figures 9A, 9B, 9C:
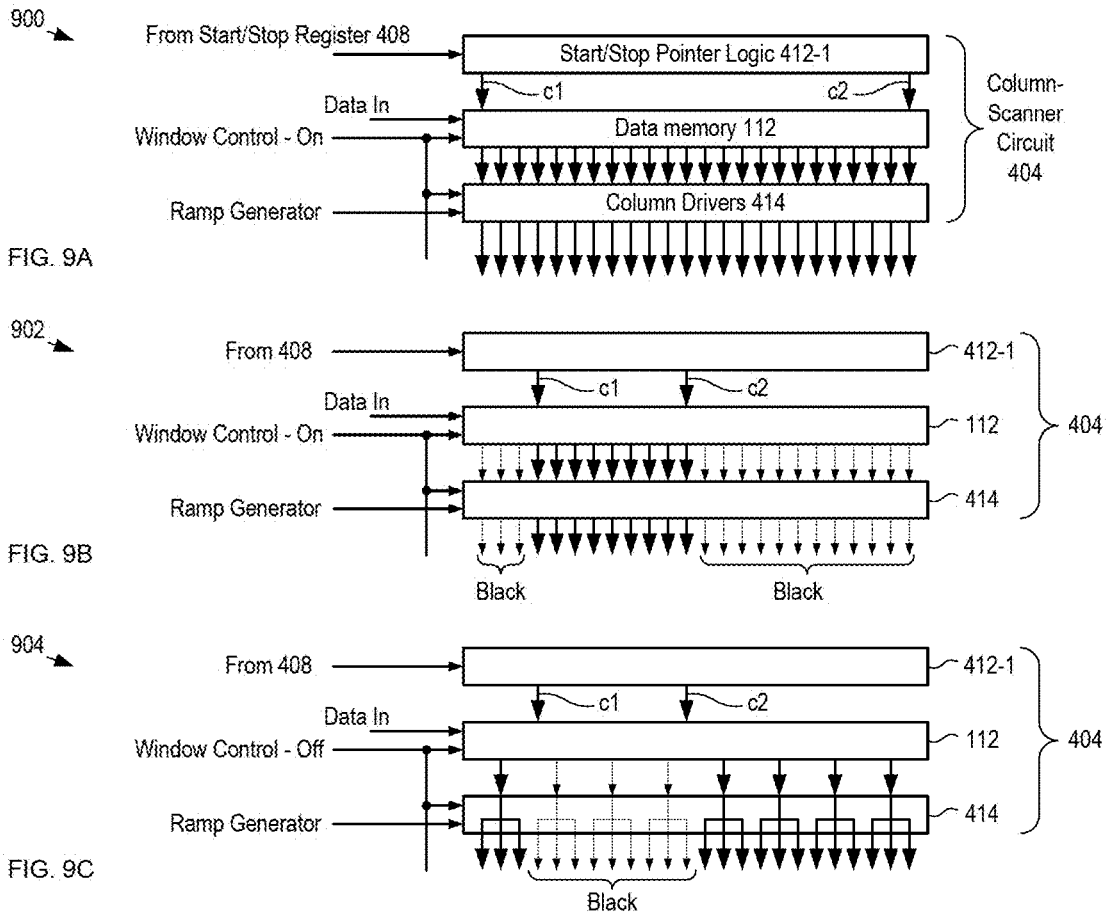
FIGS. 9A-C depict operation of a variable-density column scanner operating in different display modes in accordance with the illustrative embodiment.

FIGS. 9A-C depict operation of a variable-density column scanner operating in different display modes in accordance with the illustrative embodiment.

In display mode 900, column scanner circuit 404 operates in a full-screen, high-density mode, which is analogous to the normal operating mode of a prior-art display. In this mode, c1 is set to Col-0 and c2 is set to Col-M; therefore, all pixels in each row of the display are active and updated during each line period.

In display mode 902, column scanner circuit 404 operates in a reduced-format, high-density mode where c1 is set to Col-A and c2 is set to Col-B. This results in only the subset of columns that are located within the range of Col-A through Col-B being active, as dictated by start/stop pointer logic 412-1. As noted above, all column lines outside this range are continuously driven to black via the RST function.

In display mode 904, column scanner circuit 404 operates in a full-screen, low-density mode. In this mode, data memory 112 and column drivers 414 are re-configured so that the video data is written into only every third register and groups of three column lines are driven by each memory cell. It should be noted that, in contrast to operation 804, in display mode 904, the pointer logic is used to define the range of column lines driven to black via the RST function, which are the columns within the range of Col. A through Col. B. It should also be noted that the density change of 3× is merely exemplary and that any practical change in density can be established by using combinations of registers and column lines other than three.

Figure 10A:
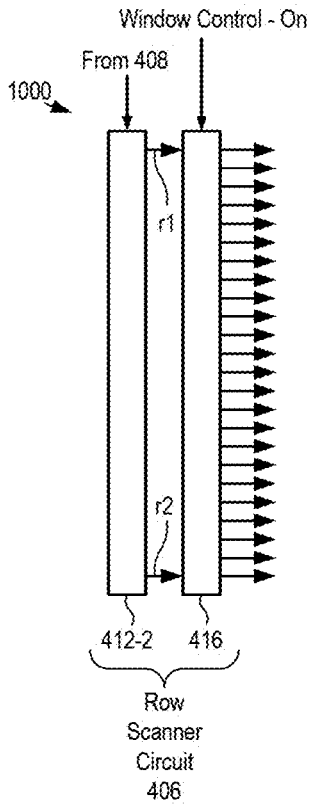
FIGS. 10A-C depict operation of a variable-density row scanner operating in different display modes in accordance with the illustrative embodiment.
Figure 10B:
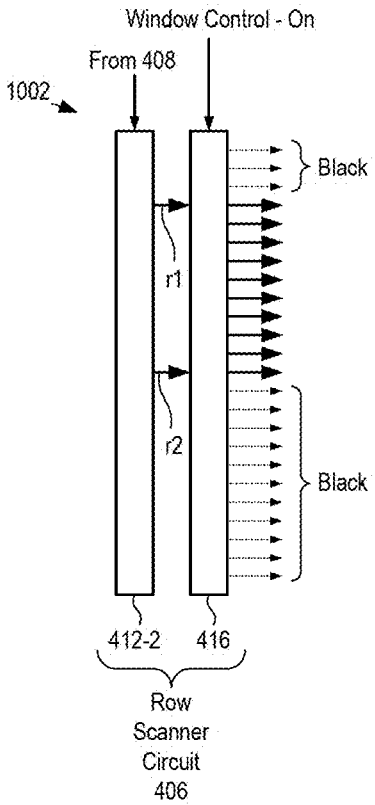
Figure 10C:
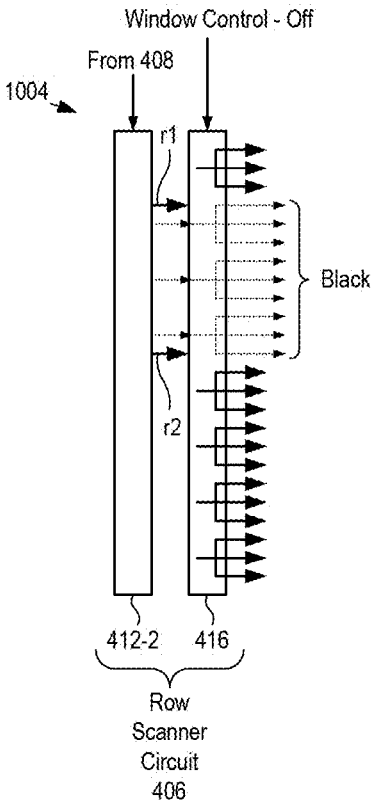
Figure 11:
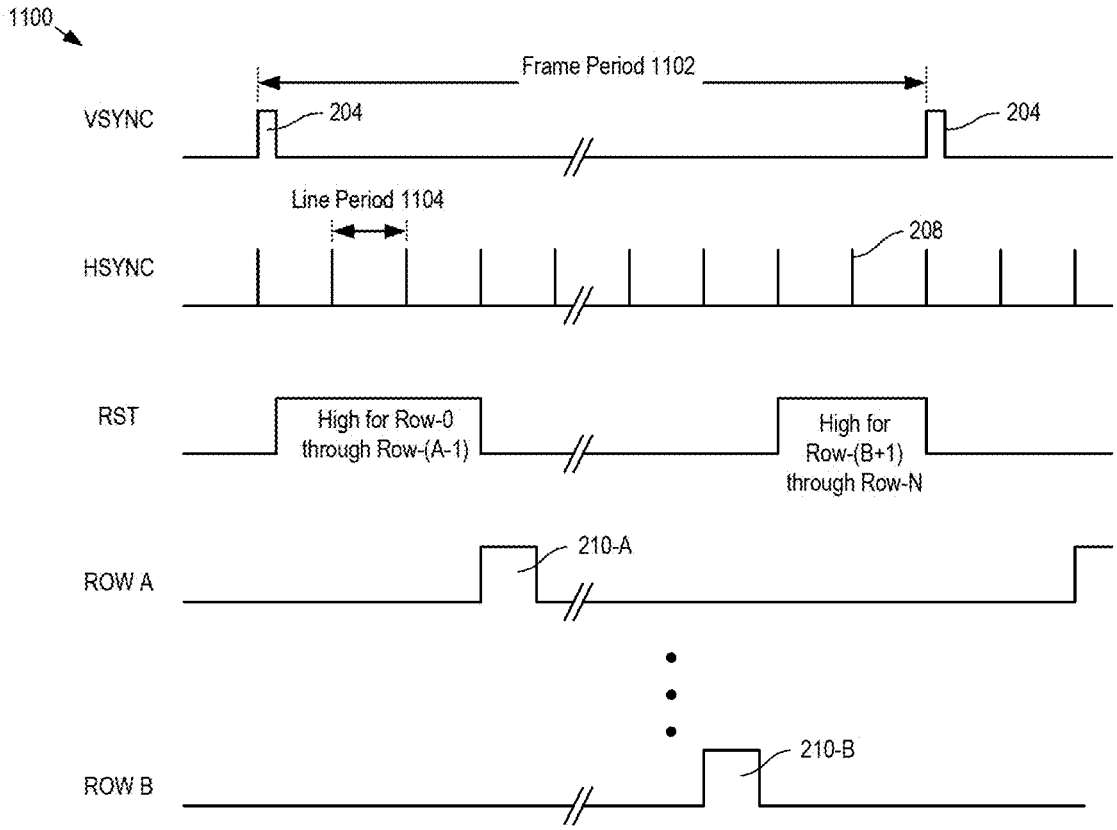
FIG. 11 depicts a timing diagram for a display frame in accordance with the illustrative embodiment.

FIGS. 10A-C depict operation of a variable-density row scanner operating in different display modes in accordance with the illustrative embodiment.

In display mode 1000, row scanner circuit 406 operates in a full-screen, high-density mode, which, like display mode 900 described above, is analogous to the normal operating mode of a prior-art display. In this mode, r1 is set to Row-0 and r2 is set to Row-M; therefore, all rows of the display are active and updated during each frame period.

In display mode 1002, row scanner circuit 406 operates in a reduced-format, high-density mode where r1 is sent to Row-A and r2 is set to Row-B. This results in only those rows within the range of Row-A through Row-B being activated and the rows outside of this range being placed into the RST state, as dictated by start/stop pointer logic 412-2.

In display mode 1004, row scanner circuit 406 operates in a full-screen, low-density configuration. In similar fashion as described above with respect to operating mode 904, in this mode, row scanner circuit 406 drives groups of three rows at a time and the row pointer logic dictates that the subset of rows range of Row-A through Row-B are driven into the RST state.

In some embodiments, a multi-resolution image is formed on display 400 to effect foveated rendering. In such embodiments, only a small region of interest is displayed at very high resolution, while a background image outside of this region is rendered at lower resolution.

One skilled in the art will recognize that the three operational modes shown in FIGS. 9A-C and 10A-C are merely exemplary and that manner other modes of operation can be effected using variable-density column and/or row scanners without departing from the scope of the present invention.

FIG. 10 depicts a timing diagram for a display frame in accordance with the illustrative embodiment. Diagram 1100 shows the timing relationship between the main clock and the row drive signals for the reduced-format virtual window depicted in FIG. 7. One skilled in the art will recognize that diagram 1100 is substantially representative of the timing relationship between the main clock and the column drive signals as well.

Region 704 includes the rows within the range of Row-A through Row-B. All of rows Row-0 through Row-N outside this range are set to black via the RST function by driving RST high, as described above and with respect to FIG. 6.

Rows within the range of Row-A through Row-B are updated in the normal sequential fashion during a frame period. Since fewer rows are being driven in a reduced-format mode, frame period 1102 can be shorter than frame period 202 enabling an increased frame rate. In embodiments wherein column scanner circuit 404 also operates in a reduced-format mode, line period 1104 can also be shortened, enabling an additional increase in the frame rate.

It is to be understood that the disclosure teaches just some examples of the illustrative embodiment and that many variations of the invention can easily be devised by those skilled in the art after reading this disclosure and that the scope of the present invention is to be determined by the following claims.

What is claimed is:

1. A display for displaying an image, the display comprising:

a pixel array having a plurality of pixels that is arranged into a first plurality of rows and a first plurality of columns, wherein the first plurality of rows includes N rows and the first plurality of columns includes M columns, and wherein each pixel of the plurality thereof includes:

(i) an organic light-emitting diode (OLED) that emits light based on a first drive current through the OLED, OLED having a first terminal and a second terminal;

(ii) a data line configured to receive a data signal for establishing the first drive current;

(iii) a first transistor that is operative for disabling the first drive current in response to a first signal that is independent of the data signal, wherein the first transistor has a first source, a first drain, and a first gate;

(iv) a second transistor having a second source, a second drain, and a second gate, wherein the second transistor is electrically connected in series with the OLED between a first power supply and ground such that (a) the second drain is electrically connected to the first power supply, (b) the second source is electrically connected to the first terminal, and (c) the second terminal is electrically connected to ground; and (v) a capacitor having a third terminal and a fourth terminal, wherein the capacitor is electrically connected in parallel with the first transistor between the second gate and ground such that (a) the third terminal, the first drain, and the second gate are electrically connected at a first node for receiving the data signal and (b) the fourth terminal and the first source are electrically connected at a second node that is electrically connected with ground;

wherein the first gate is electrically connected to a reset line for receiving the first signal such that, when the first signal is provided to the reset line, the first transistor discharges the capacitor and electrically connects the second gate to ground; and a driver architecture operative for providing first and second pointers that define the lateral extent of the image and third and fourth pointers that define the vertical extent of the image, the image comprising a second pixel array having a second plurality of columns and a second plurality of rows, wherein the first plurality of columns includes the second plurality of columns and the first plurality of rows includes the second plurality of rows;

wherein the driver architecture selectively provides the first signal to each pixel of the first pixel array not included in the second pixel array; and wherein the driver architecture provides the data signal only to pixels included in the second pixel array.

2. The display of claim 1 wherein the driver architecture further includes start/stop pointer logic for providing the first and second pointers.

3. The display of claim 1 wherein the drive architecture includes:

(i) a column scanner circuit that is dimensioned and arranged to selectively provide a first drive signal to each column of the second plurality thereof; and (ii) a row scanning circuit that is dimensioned and arranged to selectively provide a second drive signal to each row of the second plurality of rows;

wherein at least one of the column scanner circuit and row scanner circuit is operative for providing the first signal.

4. The display of claim 1 wherein the first pointer and third pointer define the position of the image within the display.

5. The display of claim 1 wherein the driver architecture is operative for writing at least one image datum into a third plurality of columns within the second plurality of thereof.

6. The display of claim 5 wherein the driver architecture is operative for writing at least one image datum into a third plurality of rows within the second plurality of thereof.

7. A display for displaying an image, the display comprising:

a plurality of pixels that is arranged into a first plurality of rows having N rows and a first plurality of columns having M columns, each pixel of the plurality thereof including (i) an organic light-emitting diode (OLED) that emits light based on a data signal and (ii) a first transistor that is operatively coupled with the OLED, the first transistor having a first source, a first drain, and a first date, (iii) a second transistor having a second source, a second drain, and a second gate, wherein the second transistor is electrically connected in series with the OLED between a first power supply and ground such that (a) the second drain is electrically connected to the first power supply, (b) the second source is electrically connected to the first terminal, and (c) the second terminal is electrically connected to ground, and (iv) a capacitor having a third terminal and a fourth terminal, wherein the capacitor is electrically connected in parallel with the first transistor between the second gate and ground such that (a) the third terminal, the first drain, and the second gate are electrically connected at a first node for receiving the data signal and (b) the fourth terminal and the first source are electrically connected at a second node that is electrically connected with ground, wherein the first gate is electrically connected to a reset line for receiving the first signal such that, when the first signal is provided to the reset line, the first transistor discharges the capacitor and electrically connects the second gate to ground and puts the pixel into a non-emissive state; and a driver architecture for driving each pixel of the plurality thereof, wherein the driver architecture is reconfigurable such that it can selectively drive a second plurality of columns having a number of columns that is controllable within the range of 1 through M, and wherein the first plurality of columns includes the second plurality of columns;

wherein the driver architecture is operative for (1) providing the first signal to each pixel of the plurality thereof not included in the second plurality of columns and (2) providing the data signal to only pixels included in the second plurality of columns.

8. The display of claim 7 wherein the driver architecture is reconfigurable such that it can selectively drive a second plurality of rows having a number of rows that is controllable within the range of 1 through N, wherein the first plurality of rows includes the second plurality of rows, and wherein the driver architecture is further operative for (3) providing the first signal to each pixel of the plurality thereof not included in the second plurality of rows and (4) providing the data signal to only pixels included in the second plurality of rows.

9. The display of claim 8 wherein the driver architecture is further operative for disabling the OLED in each of the plurality of pixels not included in both of the second plurality of columns and the second plurality of rows.

10. The display of claim 7 wherein the driver architecture includes:

a first start/stop pointer logic that is operative for providing a first pointer and a second pointer, the columns included in the second plurality thereof being based on the first and second pointers;

a column scanner circuit that is dimensioned and arranged to selectively drive each of the second plurality of columns; and first logic for disabling the OLED of each pixel of the plurality thereof not included in the second plurality of columns.

11. The display of claim 10 wherein the driver architecture is reconfigurable such that it can selectively drive a second plurality of rows having a number of rows that is controllable within the range of 1 through N, and wherein the driver architecture further includes:

a second start/stop pointer logic that is operative for providing a third pointer and a fourth pointer, the rows included in the second plurality thereof being based on the third and fourth pointers;

a row scanner circuit that is dimensioned and arranged to selectively drive each of the second plurality of rows; and second logic for disabling the OLED of each pixel of the plurality thereof not included in the second plurality of rows.

12. A method for displaying an image on a display, the method comprising:

(1) providing the display such that it includes:

(i) a first plurality of pixels arranged into a first plurality of rows having N rows and a first plurality of columns having M columns, each pixel of the first plurality thereof including an organic light-emitting diode (OLED), a first transistor having a first source, a first drain, and a first gate, a second transistor having a second source, a second drain, and a second gate, wherein the second transistor is electrically connected in series with the OLED between a first power supply and ground such that (a) the second drain is electrically connected to the first power supply, (b) the second source is electrically connected to the first terminal, and (c) the second terminal is electrically connected to ground, and a capacitor having a third terminal and a fourth terminal, wherein the capacitor is electrically connected in parallel with the first transistor between the second gate and ground such that (a) the third terminal, the first drain, and the second gate are electrically connected at a first node for receiving the data signal and (b) the fourth terminal and the first source are electrically connected at a second node that is electrically connected with ground, wherein the first gate is electrically connected to a reset line for receiving the first signal such that, when the first signal is provided at the reset line, the first transistor discharges the capacitor and electrically connects the second gate to ground to disable the OLED; and (ii) a display architecture that is operative for driving each pixel of the first plurality thereof and providing the first signal to each pixel of the first plurality thereof;

(2) providing first and second pointers that define the lateral extents of the image;

(3) defining a second plurality of columns based on the first and second pointers, the second plurality of columns having a number of columns that is controllable within the range of 1 through M, wherein the first plurality of columns includes the second plurality of columns;

(4) selectively writing data to the pixels of the second plurality of columns;

(5) selectively energizing the pixels of the second plurality of columns; and (6) disabling the OLED of each pixel not included in the second plurality of columns by providing the first signal to its respective first transistor.

13. The method of claim 12 further comprising:

(7) providing third and fourth pointers that define the vertical extents of the image;

(8) defining a second plurality of rows based on the third and fourth pointers, the second plurality of rows having a number of rows that is controllable within the range of 1 through N, wherein the first plurality of rows includes the second plurality of rows; and (9) disabling the OLED of each pixel not included in the second plurality of rows.

14. The method of claim 12 further comprising (7) reducing the resolution of the image by writing at least one image datum to pixels of a plurality of columns of the second plurality thereof.

* * * * *